US006230763B1

(12) United States Patent
Till

(10) Patent No.: US 6,230,763 B1
(45) Date of Patent: May 15, 2001

(54) METHOD AND DEVICE FOR FILLING BARRELS

(75) Inventor: Volker Till, Hofheim (DE)

(73) Assignee: Gea Till GmbH & Co., Kriftel (DE)

( * ) Notice: Subject to any disclaimer, the term of this patent is extended or adjusted under 35 U.S.C. 154(b) by 0 days.

(21) Appl. No.: 09/380,361

(22) PCT Filed: Mar. 18, 1998

(86) PCT No.: PCT/EP98/01549

§ 371 Date: Aug. 30, 1999

§ 102(e) Date: Aug. 30, 1999

(87) PCT Pub. No.: WO98/49088

PCT Pub. Date: Nov. 5, 1998

(30) Foreign Application Priority Data

Apr. 29, 1997 (DE) ..... 197 18 130
May 14, 1997 (DE) ..... 197 20 170

(51) Int. Cl.[7] ..... B65B 1/04

(52) U.S. Cl. ..... 141/48; 141/9; 141/100; 137/170.3

(58) Field of Search ..... 141/39–50, 9, 141/100, 63, 64; 137/170.1, 170.2, 170.3

(56) References Cited

U.S. PATENT DOCUMENTS 2,357,245 * 8/1944 Wetherby-Williams et al. .
3,802,471 * 4/1974 Wickenhauser ..... 141/39

* cited by examiner

*Primary Examiner*—Steven O. Douglas
(74) *Attorney, Agent, or Firm*—Alix, Yale & Ristas, LLP

(57) ABSTRACT

Disclosed is a method for filling barrels (4), specially kegs, with liquids, wherein at least one gas is dissolved. The barrel (4) is pre-stressed using a gas before the liquid is filled. Liquid is then fed into the barrel (4) by means of a filling valve (2) pertaining to a filling station (1) and connected to a feed line (3, 8). During filling, the pre-stress gas contained in the barrel (4) is evacuated. So as not to impair the product, the pre-stress gas in the barrel (4) is pre-stressed at only a partial pressure which corresponds approximately to the saturation pressure of the $CO_2$ or $N_2$ which is dissolved in the filled liquid. Said partial pressure is lower than the maximum product pressure occurring in the feed line (8) prior to the filling valve (2).

18 Claims, 2 Drawing Sheets

METHOD AND DEVICE FOR FILLING BARRELS

CROSS REFERENCE TO RELATED APPLICATION

This is the U.S. national phase of International Application No. PCT/EP98/01549 filed by Mar. 18, 1998.

BACKGROUND OF THE INVENTION

The invention concerns a method for filling barrels, especially kegs, with liquids, in which at least one gas is dissolved, whereby the barrel is pre-stressed with a pre-stress gas before being filled with liquid, after which liquid is fed to the barrel by means of a filling valve of a filling station, connected to a feed line, and the pre-stress gas contained in the barrel is removed during the filling process, as well as a device to carry out this method.

Carbon dioxide-containing beverages such as beer only keep their $CO_2$ in solution, if the partial pressure of the $CO_2$ gas above the liquid is at least as high as the saturation pressure in the liquid. If the gas pressure above the liquid is below the saturation pressure, the liquid loses $CO_2$; but if the gas pressure is substantially above this, there is a danger that additional $CO_2$ will go into solution. The uptake of gas will depend on the differential pressure between the saturation pressure in the liquid and the partial pressure above the liquid, the time available for the gas exchange, which is generally the same as the filling time of the barrel, and the size of the gas exchange area, i.e., the liquid surface. The danger of a gas uptake during the filling is significantly increased because of turbulence in the liquid occurring during the filling process. However, the gas exchange between liquid and the overlying gas atmosphere concerns not only the $CO_2$, but also other gases present in the gas atmosphere, especially oxygen, which is taken up by the liquid according to the same laws. Yet oxygen is a major factor of product quality in the case of liquids, which call be damaged by microorganisms or whose shelf life is endangered by oxidatior of the liquid's components.

In order to get the product through a valve into the barrel, whether a bottle or a keg, a differential pressure between feed line and interior of the barrel is necessary. The magnitude of the differential pressure determines the inflow rate of the product. Usually, in order to avoid increases of surface due to turbulence, the product is filled with initially low speed, which is then slowly increased. For this, the barrel is pre-stressed with a gas pressure that is substantially higher than the saturation pressure of the gas dissolved in the liquid. The actual liquid being filled is also maintained at this pressure level by tanks or pumps and supplied to the filling machine. After the pre-stressing of the barrel to the pressure of the supplied liquid, a connection is established between barrel and product feed line. The filling of the barrel with product is made possible by controlled venting of the pre-stress gas present in the barrel. In this process, the differential pressure which is built up determines the flow rate of the liquid. Moreover, it is known that the gas escape is throttled toward the end of the filling, which reduces the differential pressure between the interior of the barrel and the feed line. This has the effect of reducing the quantity of product filled per unit of time toward the end of the filling process, which enables a precise shutoff when reaching a set quantity. This known method is termed "back gas control". The advantage of this control method is that the gas pressure above the liquid is at all times above the saturation pressure of the $CO_2$ gas.

The pre-stress pressure to be established is found by trial and error. At the start of the filling, the product should lose $CO_2$ through turbulence, which results in local underpressures. This produces a desirable artificial foam on the liquid surface, whose bubbles contain only the released $CO_2$ and, thus, protect the product against contact with the oxygen-containing gas atmosphere above it. During the further filling, the turbulence vanishes and so do the local underpressures. During the remaining fill time, the product again takes up $CO_2$. Thus, the trick is to achieve an equilibrium between loss and further uptake of $CO_2$ as a function of $CO_2$ content, temperature, barrel size, and estimated filling time.

Apart from the fact that the barrel has to be pre-stressed far above the saturation pressure in the case of back gas control and venting has to be conducted in a controlled manner in order to achieve a controlled filling rate, the reduction in the filling rate in the last filling segment is a problem. At constant inlet pressure of the liquid, the flow velocity can only be reduced if the differential pressure is decreased. For this, in the known techniques, the gas escape is throttled (or shut off, in extreme cases) and one waits until the increasing liquid level has achieved a reduction of the counterpressure to the desired value by compressing the remaining gas volume present in the barrel. This period of time can be considerable, especially in the case of beer barrels. Thus, a 50-liter keg usually has an inlet cross section DN21 and a maximum filling rate of 3 l/sec. at a differential pressure of 0.8 bar. If the keg is filled with 35 liters, then 15 liters of gas space must be compressed by 0.7 bar to reduce the rate. This requires $15 \times 0.7 = 10.5$ liters of liquid and (given the reducing rate of filling) around 8 seconds of filling time. Thus, a fast, accurate control is not possible, especially with possible fluctuation in feed pressures. Even more critical is the situation when not just one gas (for example, $CO_2$), but two gases (for example, $CO_2$ and $N_2$) are deliberately dissolved in the product. $N_2$ is added to beer nowadays for its foam stabilizing action. The best example of this is stout beer, whose creamy, long-lasting foam is produced by the dissolved $N_2$ released during tapping. But $N_2$ and $CO_2$ have completely different solubilities and saturation pressure curves. While $CO_2$ goes easily into solution and can only be brought out of solution with difficulty, it is extremely hard to place $N_2$ in solution at all, and very easy to take it out of solution with the smallest amount of turbulence. A balance between outgassing at the start of filling and recapture of lost gas during the filling is almost impossible to find in the case of 2-gas systems. The quality of the product being filled therefore fluctuates. One tries to compensate for this by maintaining the ratio of the gas atmosphere $CO_2$ to $N_2$ different than the proportion of the dissolved gases. But this compromise only holds for one temperature or one barrel size and only for one product feed pressure. Mastery of these many factors and their tolerances with a control technique is not possible. Another drawback of back gas control is that the barrel needs to be pre-stressed far above the saturation pressure with gas, generally $CO_2$, in order to accomplish a pressure drop, which still lies above the saturation pressure of the gas even during maximum lowering of the interior pressure during the filling process. Since the gas is released into the atmosphere, the consequence is thus an increased consumption of the greenhouse gas $CO_2$, in addition to the consumption of energy.

Thus the object of the invention is to make smooth filling possible and to reduce the consumption of pre-stressing gas.

In accordance with the invention, this object is solved, in essence, in that the pre-stressing gas in the barrel is pre-stressed merely to a partial pressure which corresponds approximately to the saturation pressure of one of the gases which is dissolved in the liquid, which is being introduced, whereby this partial pressure is below the product pressure which is present in the supply line in front of the filling valve.

In this connection, the pre-stressing of the barrel initially takes place as closely as possible to the product pressure at the filling valve, in order that injection of the product into the barrel shall be prevented when opening the filling valve. Instead of producing the pressure difference for the filling process by reducing the level of gas pressure in the barrel and keeping the product supply pressure constant, as in the case of return gas regulation, it is proposed according to the invention that the internal gas pressure in the barrel be kept constant and that the product supply pressure at the inlet of the barrel be increased, in order to produce the necessary pressure difference.

There are basically two possibilities in this regard for introducing the product into the supply line. This can take place either as is provided in the case of a first form of embodiment of the invention, by producing a pressure that is at or is released into the atmosphere, the consequence is thus an increased consumption of the greenhouse gas $CO_2$ in addition to the consumption of energy.

A bottle-filling plant is known from U.S. Pat. No. 3,395,739 which operates in conjunction with a carbonization plant. A pump is installed behind the carbonization plant; in order to improve the solubility of the carbon dioxide, the pump increases the beverage pressure considerably above the saturation pressure of the liquid. A condenser (or a heating unit which briefly heats objects to high temperatures with a condenser which is connected with it) is connected to the pump, whereby the condenser will reduce the saturation pressure of the solution. However, a higher pressure than the saturation pressure will be maintained via a pressure maintaining device, whereby the liquid is supplied to the filling head at a pressure of 35 to 40 psi. Filling takes place via the valve in the filling head by means of a drop in pressure, whereby the pressure is reduced to approximately 10 psi before the liquid is introduced into the bottle which has been pre-stressed at approximately 6 psi. However, no form of regulation device is assigned to the valve of the filling head. This means that the filling pressure in front of the bottle is at a higher pressure than the pre-stressing pressure and that this pressure is decreased as a result of the pressure drop in the valve. However, the decrease in pressure is constant, so that the product pressure is constant both in front of the pressure-reduction valve and after the pressure-reduction valve. This means that no increase in pressure takes place during the filling process. Thus a controlled alteration of the filling velocity as a function of the level to which filling takes place in the barrel is impossible.

SUMMARY OF THE INVENTION

Thus the object of the invention is to make smooth filling possible and to reduce the consumption of pre-stressing gas.

In accordance with the invention, this object is solved, in essence, in that the pre-stressing gas in the barrel is pre-stressed merely to a partial pressure which corresponds approximately to the saturation pressure of one of the gases which is dissolved in the liquid, which is being introduced, whereby this partial pressure is below the product pressure which is present in the supply line in front of the filling valve.

In this connection, the pre-stressing of the barrel initially takes place as closely as possible to the product pressure at the filling valve, in order that injection cf the product into the barrel shall be prevented when opening the filling valve. Instead of producing the pressure difference for the filling process by reducing the level of gas pressure in the barrel and keeping the product supply pressure constant, as in the case of return gas regulation, it is proposed according to the invention that the internal gas pressure in the barrel be kept constant and that the product supply pressure at the inlet of the barrel be increased, in order to produce the necessary pressure difference.

There are basically two possibilities in this regard for introducing the product into the supply line. This can take place either as is provided in the case of a first form of embodiment of the invention, by producing a pressure that is at or even slightly below the pre-stressing pressure in the barrel, or a higher pressure, as is provided in accordance with a second form of embodiment of the invention.

It is common to both forms of embodiment that the difference in pressure, which is to be applied for filling, between the supply of product and the interior of the barrel of course, alters the saturation pressures of the dissolved gases, so that the value to be adjusted according to the invention must correspond to that of the product in the filled barrel. This issue never came up in the past, because the counterpressure was always considerably above the saturation pressure.

A device to carry out the above-described method with a filling station, which supplies product liquid to be filled into the barrel across a feed line and from which pre-stress gas escaping from the barrel is taken away through a return gas line, according to the invention, has in the filling station a pressure control device for establishing the filling pressure at the filling station. In this way, the product pressure can be adjusted at each filling station individually as a function of the filling quantity or filling level, completely independently of the feed pressure of the product to be filled and independent of the other filling stations provided as necessary at the filling machine. In many cases, there is also a simplification of the pressure tank commonly connected upstream to the filling machines as well as its control, since these also can be adjusted to the optimal gas mixture corresponding to the ratios at saturation pressure, without influencing the product.

Appropriately, a pressure sensor is assigned to the pressure control device for establishing the product pressure at the individual filling stations.

In a preferred embodiment of the invention, the pressure control device is a pressure increasing unit, preferably a frequency-controlled pump, with which any desired differential pressure can be produced relative to inside the barrel within fractions of a second.

Alternatively to the pressure increasing unit provided at the individual filling stations, a centrally arranged pressure increasing unit, for example, and in addition, a pressure reducing unit, particularly a controllable pressure reducing valve, can be provided at each filling station. The problem here is that only small nominal widths can be opened in the case of small flow rates, due to the high differential pressures between the product feed pressure upstream of the pressure reducing station and in the barrel downstream from the pressure reducing station, through which the product is squeezed, due to the high pressure difference with high flow velocities in the valve seat, in order to flow into the subsequently broadened pipeline at a lower rate on average. The readily soluble gas can be released by this "squeezing through" and foam up the liquid and modify its composition.

In an improvement of this concept of the invention, compensators connected in parallel are provided under certain conditions, by means of which an overly high release of gas is prevented.

According to a preferred embodiment of the invention, an overflow valve is provided in the return gas line, through which the return gas is taken away. Further modifications, advantages, and application possibilities of the invention will follow from the description of examples of embodiment and the drawing below.

DETAILED DESCRIPTION OF THE PREFERRED EMBODIMENTS

Figure 1:
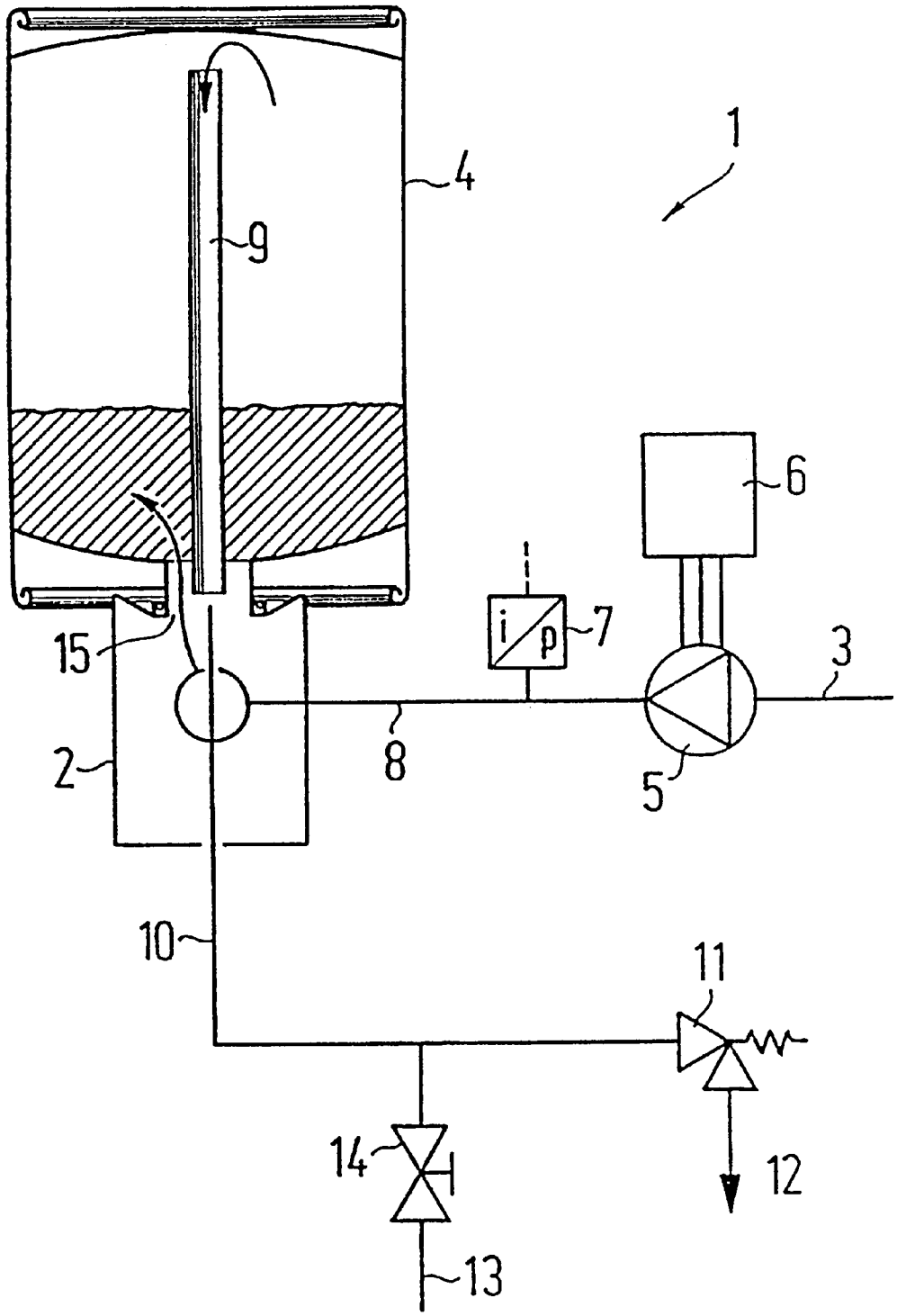
FIG. 1 shows a schematic representation of a filling station according to a first form of embodiment of the invention.

Filling station 1 shown in FIG. 1 is essentially comprised of a filling valve 2, to which a liquid such as beer, in which gases are dissolved, is conducted by means of a feed line 3. A barrel, particularly a keg 4, which will be filled with the product liquid is placed at filling valve 2.

A pressure increasing pump 5 assigned to individual filling stations 1 is provided in feed line 3, and this pump is controlled by means of a frequency converter 6 as a function of the pressure determined by a pressure sensor 7 in line segment 8 relative to filling valve 2 and the gas pressure in keg 4.

A riser pipe 9, which is joined with a return gas line 10 of filling valve 2 is provided in keg 4. Return gas line 10 leads to an overflow valve 11, by means of which access to a return gas vent 12 is controlled. Also, a pre-stress gas line 13, which can be blocked by means of a valve 14, is connected to return gas line 10.

To fill the barrel 4, this is first pre-stressed by the pre-stress gas line 13 and the return gas line 10 with a pre-stress gas, in particular, $CO_2$. In the case of certain liquids, such as stout beer, the pre-stress gas can also be a composition of several gases, such as $CO_2$ and $N_2$. The pre-stress pressure in the keg 4 is only at a partial pressure corresponding roughly to the saturation pressure of the $CO_2$ (or $N_2$) in the beer, which lies approximately at the product pressure applied upstream of filling valve 2 in the line segment 8 of the feed line 3. The counterpressure of the pre-stress gas in the keg 4 corresponds to the saturation pressure of the dissolved gas after filling the keg 4, i.e., in the filled vessel. Allowance is made for the fact that beer filled with a temperature of around 3° C. is heated by around 4° C. in the keg 4 that is usually steam-treated before the filling and therefore is around 100° C. hot. The change in the saturation pressure produced in this way is already factored in when setting the original pre-stress pressure.

If, after closing the pre-stress gas valve 14, filling valve 2 is opened, then first a balanced pressure prevails. After turning on pump 5, which is run up via a "ramp", the filling rate is slowly increased in order not to cause overly high turbulence. The beer delivered into keg 4 from feed line 8 by means of annular gap 15 in filling valve 2 presses out the pre-stress gas contained in keg 4 through riser pipe 9 from keg 4. The pre-stress gas escapes via the overflow valve 11 into return gas vent 12.

The differential pressure between the product feed pressure desired inside the keg and the pre-stress pressure can be produced via pump 5 within fractions of a second, so that the desired filling rate can be controlled exactly to the filling level without delay and individually for each individual filling station 1.

Figure 2:
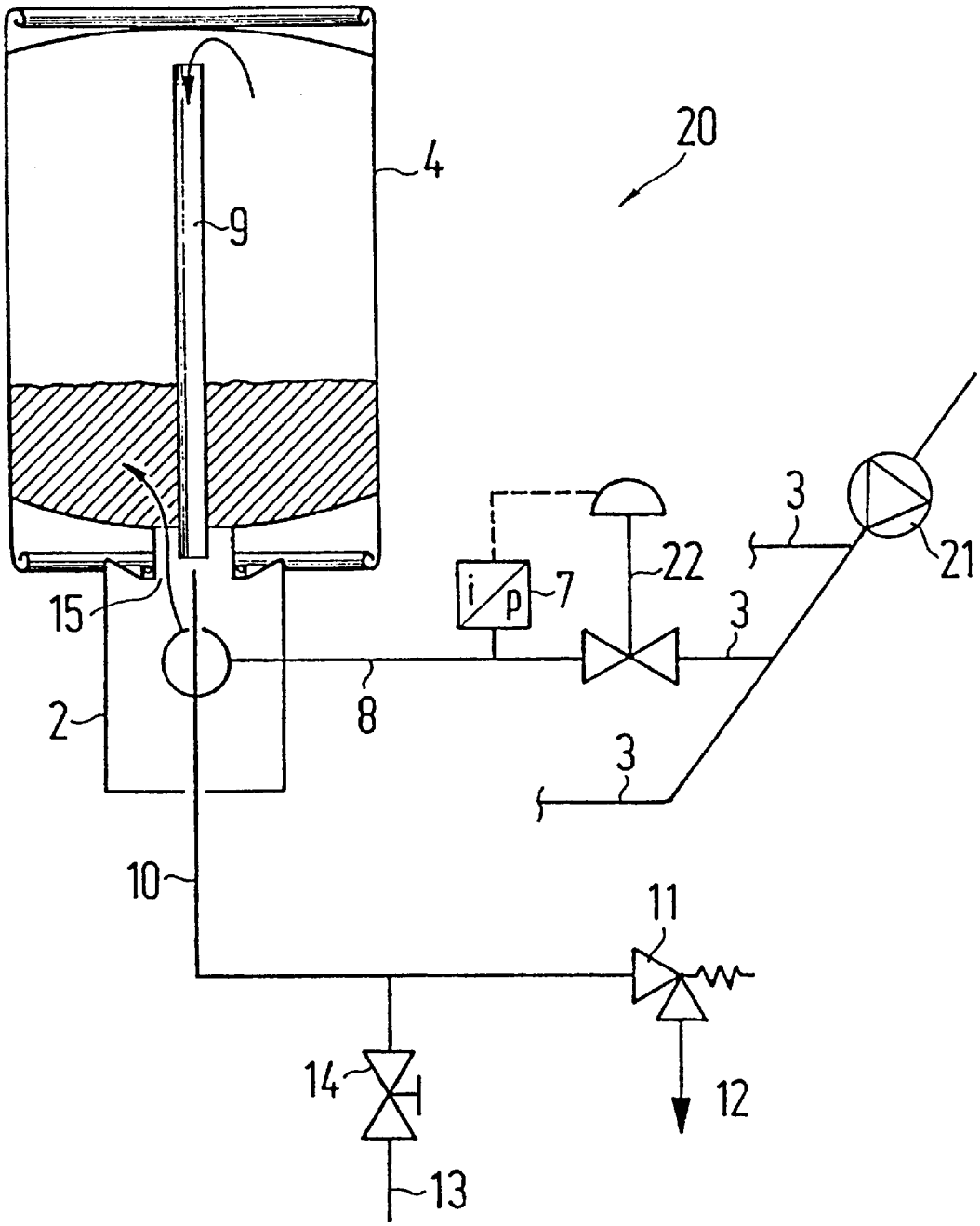
FIG. 2 shows a schematic representation of a filling station according to a second form of embodiment of the invention.

The second form of embodiment shown in FIG. 2 essentially corresponds to the form of embodiment according to FIG. 1, so that corresponding elements are designated with the same references, and their detailed description will not be repeated here.

The essential difference relative to the first form of embodiment in the case of the form of embodiment according to FIG. 2 consists of the fact that an increased pressure is adjusted in feed line 3 in the case of filling station 20 by means of a central pressure increasing unit 21. A pressure reducing valve 22 is assigned to each individual filling station 20, and this valve reduces the pressure at filling valve 2 to the desired feed pressure for the product input at filling station 20, which is detected by means of pressure sensor 7. When filling valve 2 is opened, at first a balanced pressure should also prevail here between the feed line segment 8 and the inside of barrel 4 and the differential pressure necessary for beer conveyance can be adjusted via pressure reducing valve 22 taking into consideration the pressure determined by pressure gauge 7 in feed line 8. If a higher pressure should still prevail, however in feed line 8, upon opening filling valve 2, then this is not critical due to the incompressibility of the liquid in line segment 8.

In order to avoid the circumstance that gas is released in the case of "squeezing" the liquid product standing under high pressure in feed line 3 through the valve seat of pressure reducing valve 22, compensators are provided, which are not shown in more detail, parallel to pressure reducing valve 22. The functioning otherwise corresponds to that of embodiment form 1. Also here, the differential pressure between product input line 8 and the pre-stressing pressure in keg 4 can be very rapidly adjusted by pressure reducing valve 22.

An important aspect of both forms of embodiment of the invention is that the pre-stressing in the keg 4 only needs to be adjusted to a partial pressure roughly corresponding to the saturation pressure of the $CO_2$ (or $N_2$) in the beer and thus is far below the pre-stress pressure conventionally employed. Using the pressure regulation unit assigned to each individual filling station 1, 20, it is possible to control the filling rate in the keg 4 without delay, so that a filling with unprecedented product protection is made possible. Damage from unwanted loss or uptake of $CO_2$ or uptake of oxygen from the pre-stress gas is avoided and the product quality is substantially improved by a smaller energy consumption and $CO_2$ emission.

What is claimed is:

1. A method for filling a barrel at a filling station connected to a feed line and having a filling valve with a product comprising a liquid in which at least one gas is dissolved, said method comprising:

prestressing the barrel with a prestress gas at a partial pressure roughly corresponding to the saturation pressure of one gas dissolved in the liquid;

after prestressing the barrel, feeding the product to the barrel through the feed line and the filling valve wherein a maximum product pressure is applied upstream of the filling valve, said partial pressure being less than said maximum product pressure;

controlling the pressure differential at the filling station between the product input into the barrel and the pressure inside the barrel; and removing the prestress gas from the barrel.

2. The method according to claim 1, further comprising conducting the product input into the filing station through the feed line at a pressure, which lies approximately at or slightly below the prestressing pressure in the barrel.

3. The method according to claim 1, further comprising conducting the product input into the filling station through the feed line at a pressure, which is higher than the prestressing pressure in the barrel.

4. The method according to claim 1, further comprising forcing the prestress gas from the barrel by means of the inflowing product.

5. The method according to claim 1, further comprising adjusting the prestress pressure in the barrel such that it corresponds roughly to the saturation pressure of a dissolved gas in the filled barrel.

6. The method according to claim 1, wherein at least one gas dissolved in the liquid being filled is selected from the group consisting of $CO_2$ and $N_2$.

7. An apparatus for carrying out a method wherein a barrel is filled with a product comprising a liquid in which at least one gas is dissolved and the barrel is prestressed with a prestress gas before being filled with the liquid, said apparatus comprising:

a filling station connected to a feed line, by which product is supplied for filling a barrel provided at the filling station, and a return gas line, by which prestress gas escaping from the barrel is taken away;

a pressure control device for establishing the filling pressure in the feed line of the filling station; and a pressure sensor associated with the pressure control device.

8. An apparatus for carrying out a method wherein a barrel is filled with a product comprising a liquid in which at least one gas is dissolved and the barrel is prestressed with a prestress, gas before being filled with the liquid, said apparatus comprising:

a filling station connected to a feed line, by which product is supplied for filling a barrel provided at the filling station, and a return gas line, by which prestress gas escaping from the barrel is taken away;

a pressure control device for establishing the filling pressure in the feed line of the filling station; and a pressure sensor associated with the pressure control device, wherein the pressure control device is a pressure increasing unit.

9. The apparatus according to claim 8, wherein the pressure increasing unit is a frequency-controlled pump.

10. An apparatus for carrying out a method wherein a barrel is filled with a product comprising a liquid in which at least one gas is dissolved and the barrel is prestressed with a prestress gas before being filled with the liquid, said apparatus comprising:

a filling station connected to a feed line, by which product is supplied for filling a barrel provided at the filling station, and a return gas line, by which prestress gas escaping from the barrel is taken away;

a pressure control device for establishing the filling pressure in the feed line of the filling station; and a pressure sensor associated with the pressure control device, further comprising a central pressure increasing unit in the feed line and a pressure reducing unit disposed at the filling station.

11. The apparatus according to claim 10, wherein the pressure reducing unit is a controllable pressure reducing value.

12. The apparatus according to claim 11, wherein a compensator is provided parallel to the pressure reducing unit.

13. An apparatus for carrying out a method wherein a barrel is filled with a product comprising a liquid in which at least one gas is dissolved and the barrel is prestressed with a prestress gas before being filled with the liquid, said apparatus comprising:

a filling station connected to a feed line, by which product is supplied for filling a barrel provided at the filling station, and a return gas line, by which prestress gas escaping from the barrel is taken away;

a pressure control device for establishing the filling pressure in the feed line of the filling station; and a pressure sensor associated with the pressure control device, wherein an overflow valve is provided in the return gas line.

14. A method for filling barrels with a product at corresponding filling stations each connected to a feed line and having a filling valve, said product comprising a liquid in which at least one gas is dissolved, said method comprising:

prestressing the barrels with a prestress gas at a partial pressure roughly corresponding to the saturation pressure of one gas dissolved in the liquid; and after prestressing the barrels, feeding the product to the barrels through the corresponding feed line and the filling valve wherein a maximum product pressure is applied upstream of the filling valve, said partial pressure being less than said maximum product pressure; and controlling the pressure differential between the product input into the barrel and the pressure inside the barrel at each filling station.

15. The method according to claim 14, further comprising conducting the product input into each filing station through the corresponding feed line at a pressure, which lies approximately at or slightly below the prestressing pressure in the corresponding barrel.

16. The method according to claim 14, comprising conducting the product input into each filling station through the corresponding feed line at a pressure, which is higher than the prestressing pressure in the corresponding barrel.

17. The method according to claim 14, further comprising forcing the prestress gas from each barrel by means of the inflowing product.

18. The method according to claim 14, further comprising adjusting the prestress pressure in each barrel such that it corresponds roughly to the saturation pressure of a dissolved gas in the corresponding filled barrel.

* * * * *